US005211113A

United States Patent [19]

Buschulte

[11] Patent Number: 5,211,113

[45] Date of Patent: May 18, 1993

[54] PRINTING MACHINE WITH AN ELECTROCHEMICALLY CHANGEABLE PRINTING FORM, AND METHOD OF OPERATION

[75] Inventor: Rainer Buschulte, Bad Schönborn, Fed. Rep. of Germany

[73] Assignee: Heidelberger Druckmaschinen AG, Heidelberg, Fed. Rep. of Germany

[21] Appl. No.: 726,933

[22] Filed: Jul. 8, 1991

[30] Foreign Application Priority Data

Jul. 7, 1990 [DE] Fed. Rep. of Germany ..... 4021662

[51] Int. Cl.[5] ..... B41M 5/20

[52] U.S. Cl. ..... 101/467; 101/465; 101/146

[58] Field of Search ..... 101/463.1, 465, 466, 101/467, 146; 204/224 R; 205/117, 127, 151

[56] References Cited

U.S. PATENT DOCUMENTS

| | | | |
|---|---|---|---|
| 4,729,310 | 3/1988 | Love, III | 101/466 X |
| 4,872,962 | 10/1989 | Scheer et a. | 101/465 X |
| 4,873,924 | 10/1989 | Nonomura et al. | 101/146 |
| 4,959,668 | 9/1990 | Hirt | 101/467 X |

FOREIGN PATENT DOCUMENTS

| | | |
|---|---|---|
| 0101266 | 2/1984 | European Pat. Off. . |
| 0160920 | 9/1990 | European Pat. Off. . |
| 3705439 | 9/1988 | Fed. Rep. of Germany . |
| 3825850 | 2/1990 | Fed. Rep. of Germany . |

*Primary Examiner*—Edgar S. Burr
*Assistant Examiner*—Lynn D. Hendrickson
*Attorney, Agent, or Firm*—Herbert L. Lerner; Laurence A. Greenberg

[57] ABSTRACT

A printing machine for performing flat-bed printing having a printing form with hydrophobic and hydrophilic area thereon corresponding to an image to be printed, and a device for electrochemically converting, respective areas thereof for producing a printing copy from the hydrophobic into the hydrophilic state by means of a current-conduction arrangement, including a fluid applicator for applying a hydrophobic fluid full-surface to a surface of the printing form, and a control device for controlling the current-conduction arrangement for forming appropriate current paths and for electrochemically removing the hydrophobic fluid area-by-area in accordance with the hydrophilic areas required for the image to be printed; and a method of operation thereof.

3 Claims, 6 Drawing Sheets

Fig. 2a
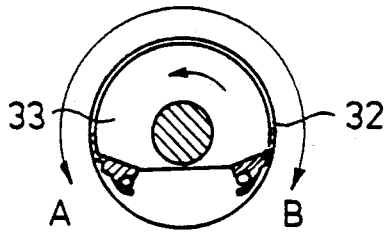
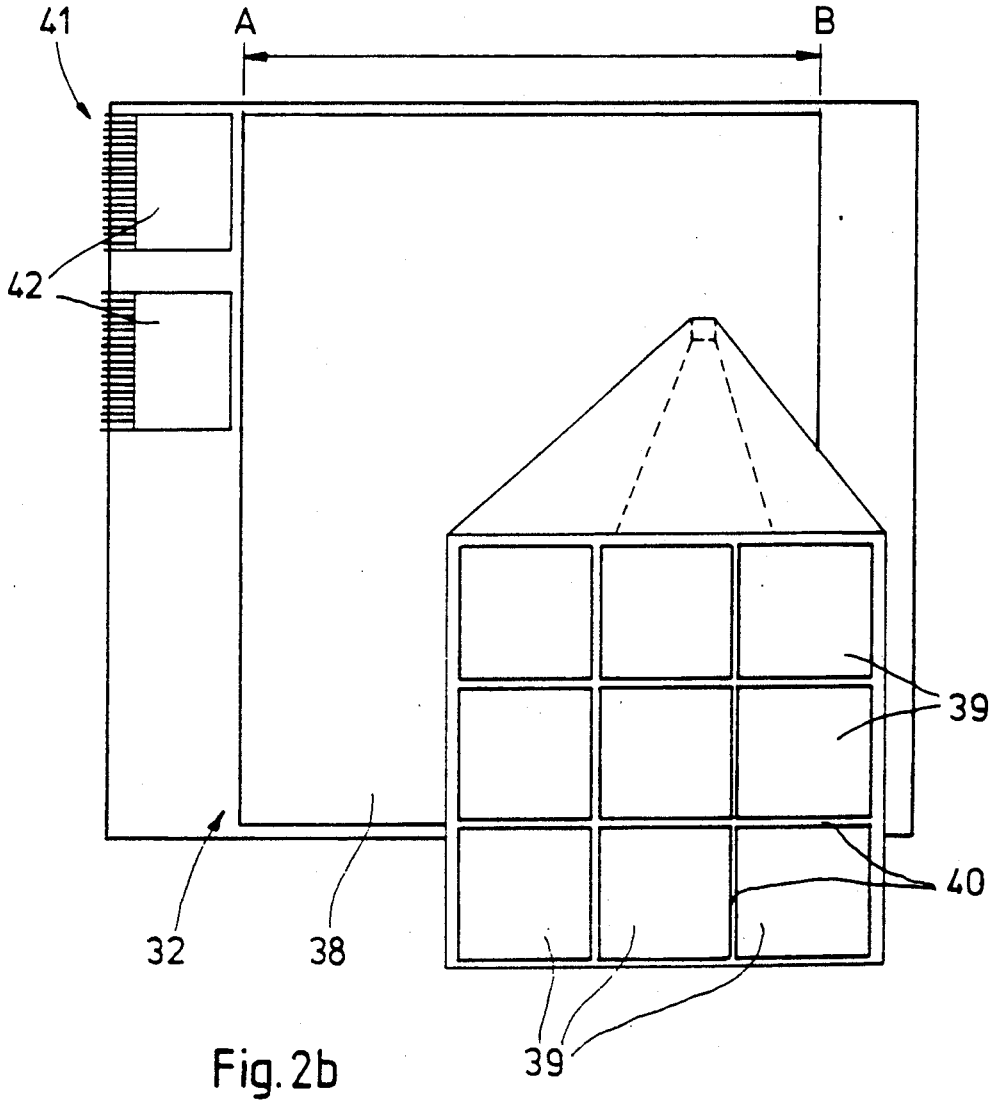
Fig. 2b

PRINTING MACHINE WITH AN ELECTROCHEMICALLY CHANGEABLE PRINTING FORM, AND METHOD OF OPERATION

The invention relates to a flat-bed printing machine, having a printing form with hydrophobic and hydrophilic areas corresponding to an image to be printed, and a device for electrochemically converting areas thereof for producing a printing copy from the hydrophobic into the hydrophilic state by means of a current conduction device.

A printing machine of the foregoing general type has become known heretofore from German Published, Non-Prosecuted Application (DE-OS) 38 25 850. The possibility of producing hydrophilic (water-receptive) and hydrophobic (water-repellent) areas, respectively on a printing form which is reversible by means of an electrochemical process has the advantage, when compared with conventional printing forms, that a change of the print image can be effected preferably within the machine in a relatively simple manner. The expensive photochemical production of the conventional printing forms, as well as their installation and removal, is therefore inapplicable. To achieve this improvement, the aforementioned German publication suggests that a hydrophobic polymer be deposited onto a hydrophilic carrier in accordance with an image to be printed or that it be removed from the carrier.

Alternatively, it has become known from this German publication that a hydrophilic polymer be deposited or removed from the hydrophobic carrier. With regard to the removal of the polymer, it is necessary first to deposit a monomer or monomer mixture as a polymer from an electrolytic solution onto the full surface of an appropriately pretreated carrier by using a given current density. In order then to produce the printing copy, the polymer must be removed again at the appropriate locations. In the absence of the monomer, this also occurs electrochemically with an anodic current of given intensity in a suitable electrolyte. After the printing copy is formed, the printing operation is started in the traditional manner, i.e., dampening solution, inking medium and finally the material on which the printing is to take place are supplied.

From the European Patent Application 101 266, a printing machine has become known heretofore wherein a printing form is coated with a hydrophobic layer which is then physically removed again in accordance with the desired subject, for example, by means of a laser beam or electrical discharges.

From German Published, Non-Prosecuted Application (DE-OS) 37 05 439, a printing machine has become known heretofore which has a printing form containing a material which can be converted from a hydrophobic state into a hydrophilic state and the reverse by electric control. By means of an electrochemical reaction, the printing form itself can thus be influenced.

It is accordingly an object of the invention to provide a printing machine of the aforementioned general type and a method of operation thereof, wherein the printing copy can be produced and modified, respectively, in an especially simple manner.

With the foregoing and other objects in view, there is provided, in accordance with the invention, a printing machine for performing flat-bed printing having a printing form with hydrophobic and hydrophilic areas thereon corresponding to an image to be printed, and a device for electrochemically converting respective areas thereof for producing a printing copy from the hydrophobic into the hydrophilic state by means of a current-conduction arrangement, comprising a fluid applicator for applying a hydrophobic fluid full-surface to a surface of the printing form, and a control device for controlling the current-conduction arrangement for forming appropriate current paths and for electrochemically removing the hydrophobic fluid area-by-area in accordance with the hydrophilic areas required for the image to be printed.

According to the invention, therefore, the fluid is used for the formation of hydrophobic areas on the printing form. In this regard, a totally new method is thus applied because, heretofore, the surface of the printing form was always provided with properties leading either to hydrophilic or hydrophobic behavior. Moreover, this characteristic or property is not produced by means of an additional solid intermediary but rather by means of a fluid. To achieve this, the total surface of the printing form is initially coated with the fluid by a fluid applicator. With the control device, appropriate areas of the fluid layer can then be dissolved out through the formation of appropriate current paths corresponding to the desired image, i.e., the fluid layer in the areas are removed electrochemically. Once this has occurred and, if necessary or desirable, after an additional application of a dampening solution, if this has not already been effected through the electrochemical process (a matter which is discussed hereinbelow in greater detail), the printing form is directly available for the printing start-up.

In accordance with an additional feature of the invention, the hydrophobic fluid is an inking medium.

In accordance with a further feature of the invention, the fluid applicator is an inking unit of the printing machine. The always present and required inking unit therefore performs a double function; by means of this unit, a full-surface coating of the printing form is initially performed for production of the printing copy and, then, in the production run, inking medium is supplied in the usual manner. It is within the scope of the invention also to include a further ink-supplying device, in addition to the usual inking unit, for use exclusively for producing the printing copy.

In accordance with an added feature of the invention, the printing form has a surface which, in untreated and unaltered state, has hydrophilic properties. A result thereof is that, after the printing ink has been removed area-by-area, dampening solution accumulates thereat in a manner ensuring that the areas covered with dampening solution, and thus ink-free, do not absorb or transfer ink during the printing process.

In accordance with an additional feature of the invention, the current-conduction arrangement includes the control device, an electrode arrangement, an electrolyte and at least one electric voltage source. The electrode arrangement includes a multiplicity of electrodes which can be energized separately by means of the control device; when they are activated, the printing ink is removed in accordance with the cross-sectional configuration of the respective current path. The image reproduction properties are therefore dependent upon the electrode density, the printed image being composed of a roster or grid of picture elements, especially half-tone dots. If one of the electrodes, and its corresponding counterelectrode or master counterelectrode, are activated, i.e., if voltage from the aforementioned electrical source is applied between these elements, a chemical process occurs at the boundary layer between the printing ink and the electrolyte, and this causes the ink to dissolve out of the ink mixture thereat and to join or flow into the electrolyte.

In accordance with again another feature of the invention, there is provided an electrolyte feeding device.

In accordance with again a further feature of the invention, the electrolyte feeding device is a dipping bath.

In accordance with again an added feature of the invention, the printing form dips directly into the dipping bath.

In accordance with again an additional feature of the invention, the printing form is wetted by the dipping bath through the intermediary of a feed roller.

In accordance with yet another feature of the invention, the electrolyte feeding device is a spraying device for spraying the electrolyte onto the printing form.

In accordance with an additional feature of the invention, the electrolyte is dampening solution. Thus, simplification is again achieved, because the dampening solution must also be made ready for the printing operation. In particular, it is also possible, in this respect, that a dampening unit should apply the electrolyte as dampening solution to the printing form. A conventional dampening unit is therefore used, in this regard, and thus performs, like the inking unit, a double function; it is used both for producing the printing copy and for performance of the production printing operation.

In accordance with a further feature of the invention, the electrodes of the electrode arrangement are formed on the surface of the printing form.

In accordance with an added feature of the invention, there is provided a counterelectrode arranged in the dipping bath.

In accordance with an alternate feature of the invention, the dipping bath is received in a tank, and the tank forms a counterelectrode.

In accordance with another alternate feature of the invention, there is provided a counterelectrode formed by a counterelectrode feed roller cooperatively engaging the printing form via an electrolyte bridge.

This arrangement can be employed, for example, when the spraying device is used. If a dipping bath is used and the electrolyte is transferred to the printing form via an intermediate roller, this intermediate roller can serve as the counterelectrode roller.

In a further embodiment of the invention, the electrode arrangement is not formed on the printing form but is formed on the counterelectrode. In this case, it is possible, for example, to use a line matrix, i.e., the individual electrodes form elements of this line matrix, so that the printing form is led past the counterelectrode stepwise, a corresponding line of the printed image being produced with each step.

In accordance with an additional feature of the invention, the electrode arrangement supplies the current paths, and a counterelectrode feeder roller includes the electrode arrangement.

In accordance with yet another feature of the invention, the printing machine includes a washing device operative with the printing form for removing ink for a change in the image to be printed. After the printing operation has ended, the ink is removed from the printing form by the washing device. A new printing copy can then be produced as follows: the full surface of the inking form is initially inked up and then areas are removed again by the electrochemical process according to the invention.

In accordance with another aspect of the invention, there is provided, in a method of operating a printing machine for performing flat-bed printing wherein the printing machine includes a printing form with hydrophobic and hydrophilic areas corresponding to an image to be printed and a device for electrochemically converting areas thereof for producing a printing copy from the hydrophobic into the hydrophilic state by means of a current conduction arrangement, the improvement therein comprises, for effecting a change in the image to be printed, shutting off a supply of dampening solution so as to permit an existing printing copy to dry, completely inking the surface of the printing form, and electrochemically producing a new printing copy. By interrupting the supply of dampening solution, the areas which are otherwise free of inking medium can absorb ink. Consequently, the full surface of the printing form is inked, so that the desired inking-medium areas can then be electrochemically removed again in accordance with the image to be printed.

In accordance with yet a further feature of the invention, an electrolyte-rinsing device is provided for removing the electrolyte after the printed image has bee produced. This is necessary, primarily, if the electrolyte has a negative influence on the printing operation, for example, if it is incompatible with the material which is being printed on. The electrolyte-rinsing device is thereby constructed in a manner that only the electrolyte, and not the printing copy produced by the printing ink, is removed.

In accordance with an alternative arrangement according to the invention, the aforementioned washing device is used not only for removing the ink for a picture change, but also for washing off the electrolyte.

In accordance with yet an added feature of the invention, the electrodes of the electrode arrangement form a capillary structure in vicinity of the surface of the printing form. This capillary structure improves the adhesion of the inking medium and the dampening solution, respectively, at the surface of the printing form.

To produce the capillary structure, in accordance with yet an additional feature of the invention, the electrodes project beyond the surface of the printing form. Depressions which form the capillaries are thereby created between the electrodes.

In accordance with another feature of the invention, in another alternative arrangement, each of the electrodes has a surface disposed at a distance from the surface of the printing form and forming a bottom of a depression. The electrodes thus lie in depressions formed in the printing form, these depressions, in turn, forming the capillaries.

In accordance with a concomitant feature of the invention, the current-conduction arrangement is a matrix-like arrangement.

Other features which are considered as characteristic for the invention are set forth in the appended claims.

Although the invention is illustrated and described herein as embodied in a printing machine with an electrochemically changeable printing form, and method of operation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic view of a layout of rollers of an offset printing machine in a production-printing phase;

FIG. 2*a* is a reduced fragmentary cross-sectional view of FIG. 1 showing a printing form cylinder of the printing machine;

FIG. 2*b* is a projected enlarged top plan view of FIG. 2*a* showing the printing form unwound in A-B direction and equipped with an electrode arrangement, and superposed by a much-enlarged view of a minute area thereof;

Figure 3:
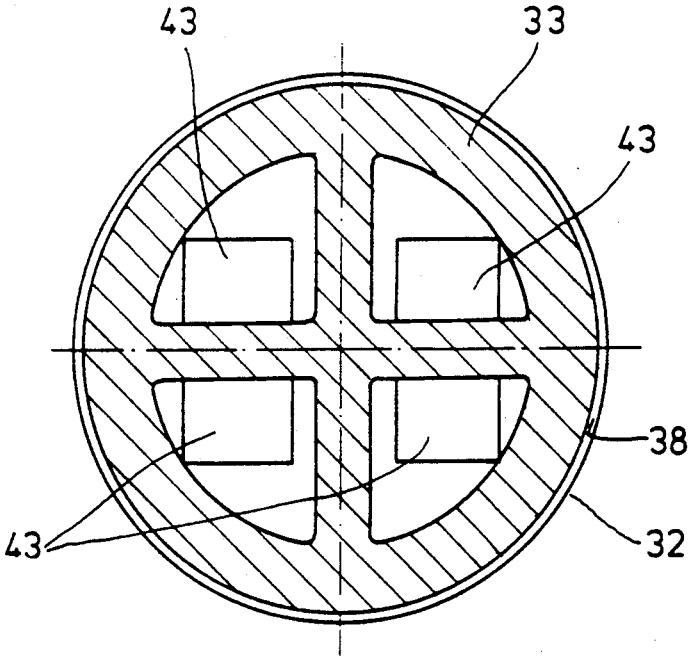
FIG. 3 is an enlarged cross sectional view of another embodiment of the printing form cylinder of FIG. 2*a* supporting an integrated printing form on the outer cylindrical surface thereof and equipped with a control device rotating together with the cylinder.
Figure 4:
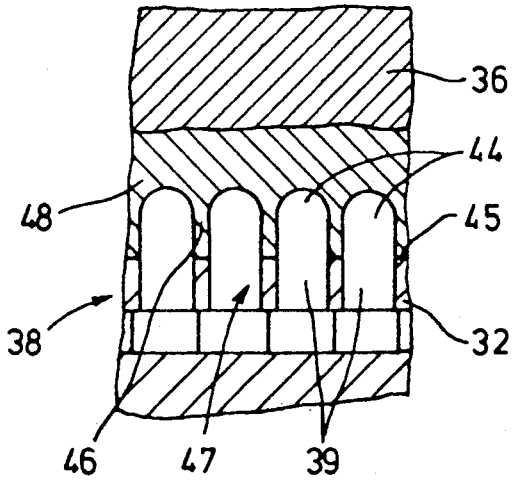
FIG. 4 is a fragmentary cross-sectional view of a surface portion of a printing form.
Figure 5A:
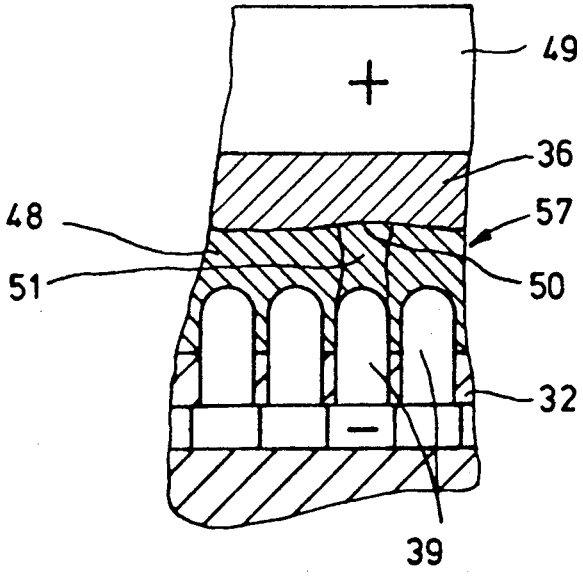
Figure 5B:
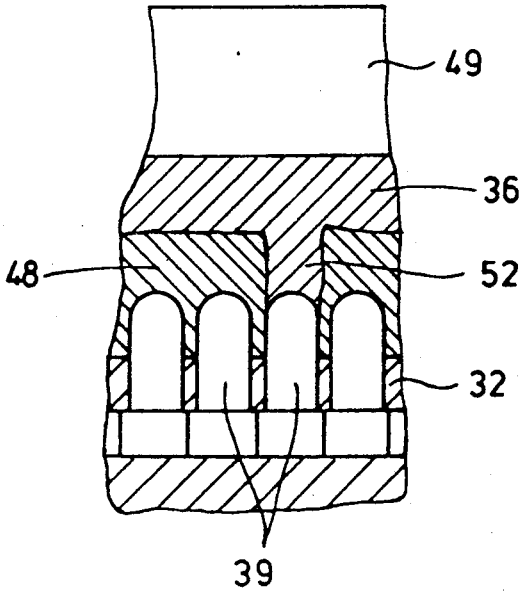
Figure 6:
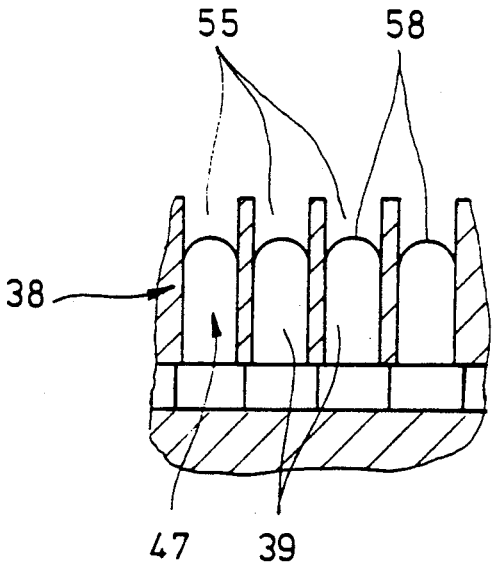
Figure 7:
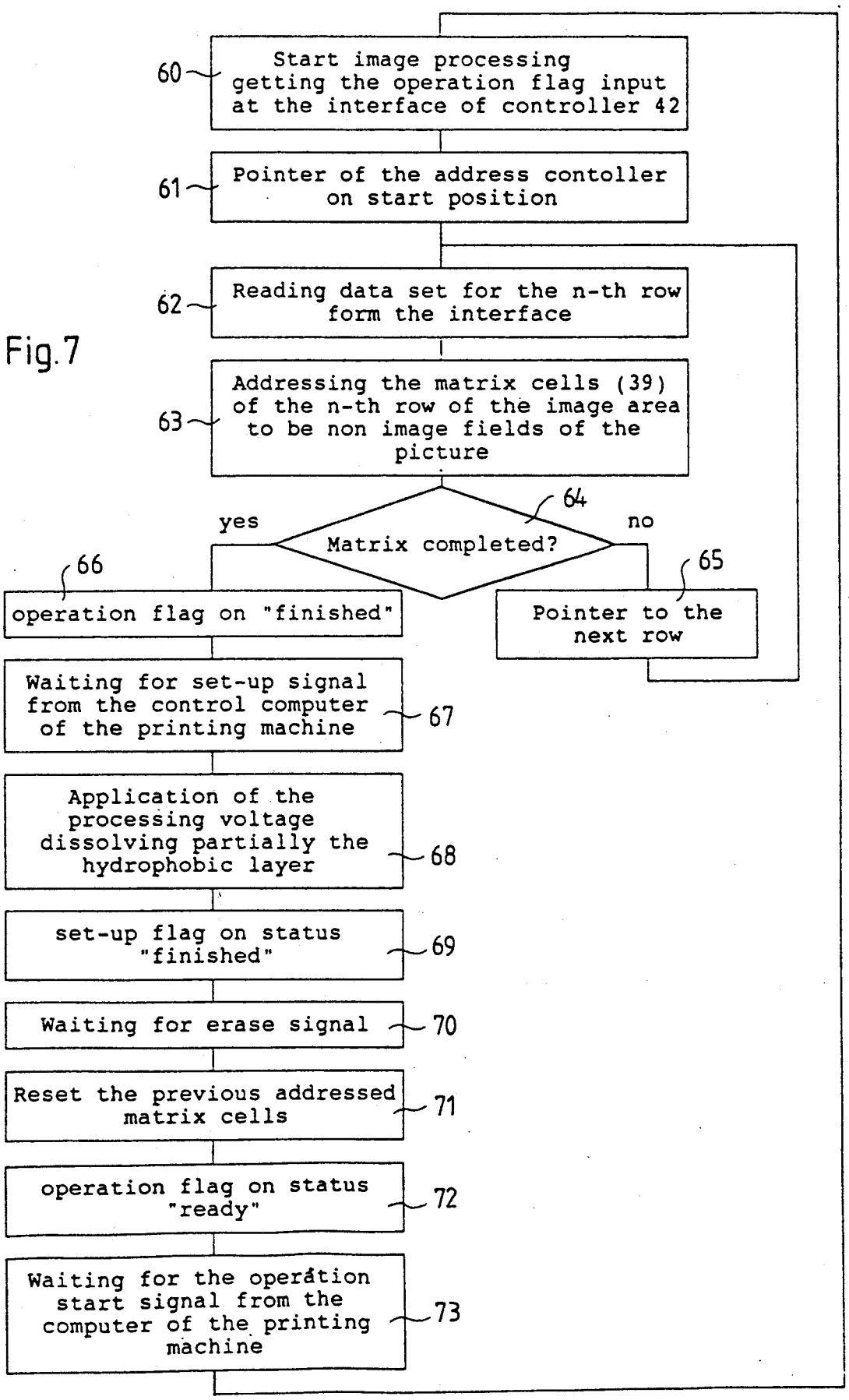

FIG. 5*a* is a view like that of FIG. 4 of another embodiment of the printing form which includes an activated electrode as well as a counterelectrode;

FIG. 5*b* is a view like that of FIG. 5*a* after termination of an electrochemical process;

FIG. 6 is a view similar to those of FIGS. 5*a* and 5*b* of another embodiment of the printing form having a different electrode arrangement; and FIG. 7 is a flow chart for the control device of FIG. 3.

Figure 1:
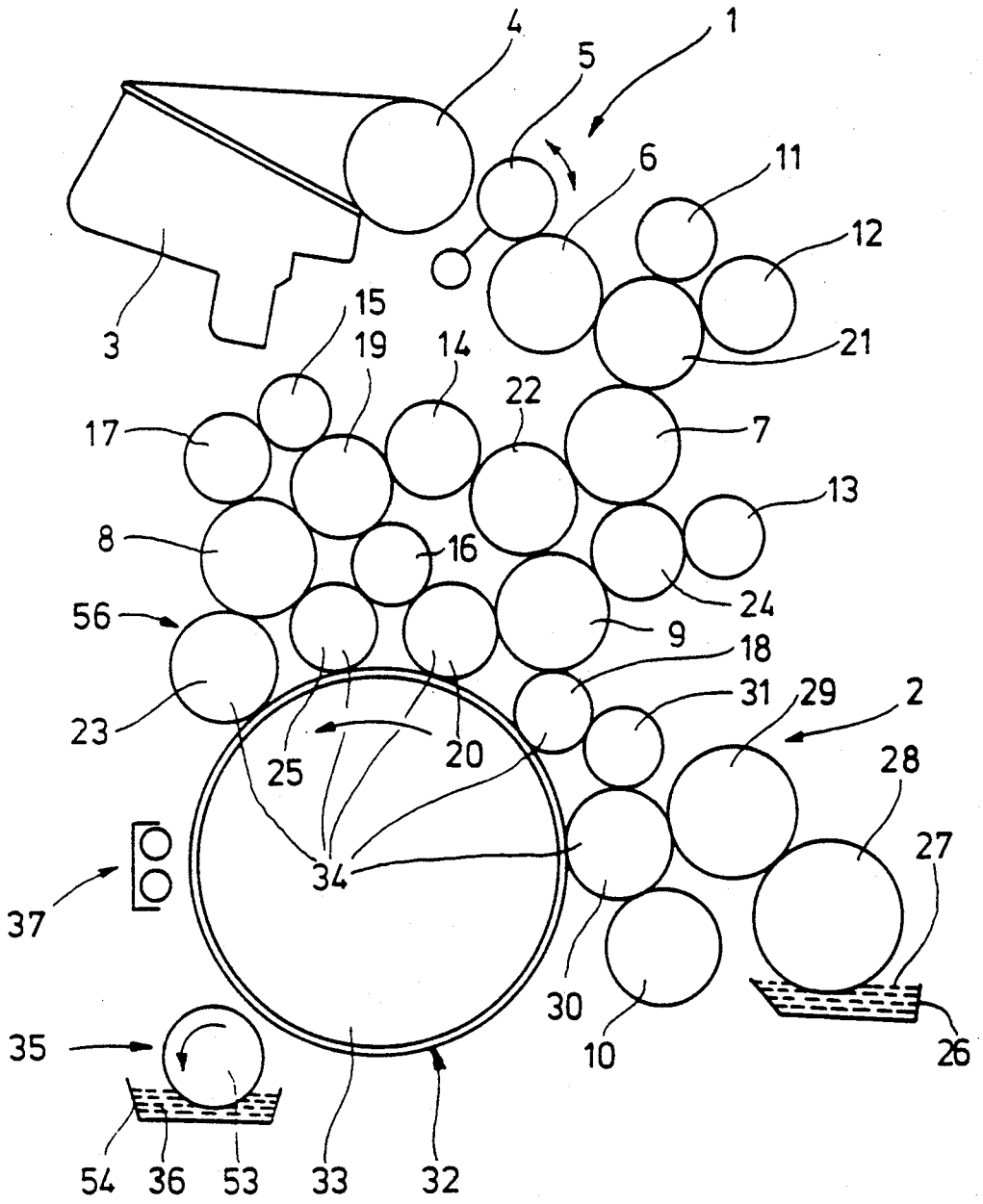

Referring now to the drawing and, first, particularly to FIG. 1 thereof, there is shown therein diagrammatically an inking unit 1 and a dampening unit 2 of an offset printing machine. The inking unit 1 has an ink duct 3 with an ink metering device, from which an ink duct roller 4 removes in metered fashion inking medium (printing ink) during operation. A duct or roller 5 cooperates with the ink duct roller 4 as well as with a driven distributor drum 6. The inking unit 1 and the dampening unit 2 also have other driven distributor drums 7, 8, 9 and 10. In addition, six rider rollers and transfer rollers 11 to 16 and two rubber rollers 17 and 18 are provided. The inking unit 1 also has two rubber rollers 19 and 20 as well as three other rubber rollers 21 to 23 having larger diameters than those of the rubber rollers 17 and 18. In addition, another two rubber rollers 24 and 25 are provided which have smaller diameters than those of the rubber rollers 19 and 20.

The dampening unit 2 includes a tank or pan 26 filled with dampening solution 27 into which a circumferential section of a dip or pan roller 28 is dipped. The dip roller 28 cooperates with a metering roller 29. In addition, a rubber roller 30 and an intermediate roller 31 are provided.

By means of the aforedescribed roller arrangement, a printing form 32 is supplied with printing ink as well as with dampening solution. The printing form 32 is positioned on a printing form cylinder 33.

A transfer of printing ink and dampening solution from the inking device 1 and from the dampening device 2, respectively, to the printing form 32 is performed by the rubber rollers 18, 20, 23, 25 and 30, which are, therefore, also known as form or applicator rollers 34.

Furthermore, an electrolyte feeding device 35 is provided, which can apply an electrolyte 36, upon demand or as required, to the surface of the printing form 32. FIG. 1 also shows a washing device 37 with which the surface of the printing form 32 can be cleaned.

FIGS. 2*a* and 2*b* illustrate an embodiment of a printing form 32 which is carried by the printing form cylinder 33. FIG. 2*b* shows the printing form 32 as a projection unwound along the line A-B. The printing form 32 may be formed as a sleeve or as a firmly attachable plate which can be placed upon the printing form cylinder 33. The plate may be a rigid unit which matches the contour of the outer cylindrical or jacket surface of the printing form cylinder 33, or it may be a flexible plate which adapts or adjusts itself to the contour. Alternatively, it is possible, however, for the printing form 32 to be an integral part of a current-conduction arrangement, such as the printing form cylinder 33, i.e., for these parts to form a homogeneous structural unit.

A common feature of all embodiments of the invention is that of an electrode arrangement 38 formed on the surface of the printing form 32 and having a multiplicity of electrodes 39 arranged like a matrix thereon. The individual electrodes 39 are electrically insulated from one another by insulating strips 40. The cross-sectional dimensions thereof are extremely small. For example, the electrodes 30 may be formed as squares with respective side or edge lengths of 4.5 $\mu$m, and the insulating strip having a thickness of 0.5 $\mu$m. In one embodiment of the invention, the surface matrix is formed of $3.3\times10^{10}$ surface elements (electrodes 39).

The individual electrodes 39 can be energized, i.e., subjected to a voltage, by means of a conventional control device 41 which is not represented in detail, one pole of the voltage source being connected with the energized electrodes 39, and the other pole of the voltage source being connected to a counterelectrode which is to be described hereinafter in greater detail. The control device 41 has address components 42 for energizing the electrodes 39.

In the embodiment of the invention according to FIG. 3, which is a cross-sectional view of a printing form cylinder 33 supporting a printing form 32 provided with an electrode arrangement 38, electronic switching circuits 43 rotate together with the printing form cylinder 33.

In FIG. 4, the construction of the electrode arrangement 38 is shown in greater detail. A section 44 of each electrode 39 projects above and beyond the surface 45 of the printing form 32. Depressions 46 are thereby formed between the individual electrodes 39, and constitute together a capillary structure 47.

The printing machine according to the invention operates in the following manner:

It is assumed that the subject of a given image to be printed was made ready or processed as data information, the data then being available to the control device 41.

In addition, it is assumed that the surface 45 of the printing form 32 is clean; it was cleaned, for example, by means of the aforementioned washing device 37.

According to the invention, the entire surface 45 of the printing form 32 is initially inked with inking medium 48 (printing ink) for producing a printing copy. This can be performed with a fluid applicator 56 (FIG. 1) which is provided in addition to the inking unit 1, or it can be performed, for example, by means of the aforementioned inking unit 1. The dampener application rollers thereby assume a position spaced a distance from the printing form 32. In addition, the intermediate roller 31 is located in a disconnected or separated position, i.e. the inking unit 1 and the dampening unit 2 are not connected to one another.

After the entire surface 45 of the printing form 32 has been inked, the printing copy is produced. To achieve this, the electrolyte 36 is applied to the ink coating or layer 48 on the printing form 32 by means of the electrolyte feeding device 35 (note FIG. 4). According to the subject to be produced, a current-conduction arrangement 57 is then activated, i.e., appropriate electrodes 39 are energized by means of the control device 41. The thus selected electrodes 39 receive the potential of one pole of the electrical voltage source. As is apparent from FIG. 5*a*, the electrolyte 36 is connected to a counterelectrode 49 which is, in turn, connected to the other pole of the electrical voltage source.

In the embodiment illustrated in FIG. 5*a*, the negative pole of the electrical voltage source is connected to the electrodes 39, while the positive pole is connected to the counterelectrode 49. This application of voltage causes an electrochemical reaction at the boundary layer 50 between the inking medium 48 and the electrolyte 36. Along the current path 51 which is formed between the electrode 39 and the counter electrode 49, inking medium 48 is electrochemically dissolved out of the ink sandwich or composite, so that a channel 52 extending to the electrode 39 is formed. By this means, the inking medium 48 assigned to the energized electrode 39 is removed, while the printing ink remains at those electrodes 39 which are not energized. After the printing copy has been produced in this manner, the electrical voltage source is switched off, as shown in FIG. 5*b*, and the counterelectrode 49 is removed.

The actual printing operation can then be started, i.e. dampening solution 27 and inking medium 48 are supplied to the printing form 32 in a conventional manner by means of the inking unit 1 and the dampening unit 2, respectively. Through the hereinaforedescribed electrochemical process, hydrophobic and hydrophilic areas have been formed. In fact, the areas allocated to the energized electrodes 39 have hydrophilic properties, and the areas allocated to those electrodes 39 which were not energized have hydrophobic properties.

By this means, the printing operation can be performed in the conventional manner of traditional offset technology.

In addition to the embodiment of the invention represented in FIG. 1, wherein the electrolyte 36 is supplied to the printing form 32 by means of a feed roller 53, it is possible, as an alternative, to use a non-illustrated spraying device, for example. In addition, in a preferred embodiment, the dampening solution 27 serves as the electrolyte 36, i.e., this can be supplied to the printing form 32 by the dampening unit 2.

This can be performed, however, only if the electrolyte 36 does not disturb the printing operation. Should the electrolyte 36 be incompatible with the printing operation, it is possible, in accordance with another feature of the invention, before printing has started, for the electrolyte feeding device 35, which is separate from the dampening unit 2, to be initially washed from the printing form 32 without damage to the created ink structure. If this has occurred, the dampening solution 27 can be supplied by the dampening unit 2 in the conventional manner.

After a printing job has ended and there is a subsequent change of the printing copy, the printing copy can be washed off the printing form 32 by means of the aforementioned washing device 37. Full surface inking with inking medium 48 can then be performed again and, by appropriate energizing of the electrodes 39 and supplying of the electrolyte 36, a new printing copy can be produced.

The aforementioned counterelectrode 49 may be formed by the feed roller 53 according to FIG. 1. In this regard, the feed roller 53 and the printing form 32 are thereby disposed at such a distance from one another that an electrolyte bridge is formed in the nip or wedge-shaped space between the feed roller 53 and the printing form cylinder 33.

In another non-illustrated embodiment, it is also possible for the tank or pan 54 containing the electrolyte 36 to serve as the counterelectrode 49. In such a case, the feed roller 53 can be omitted, because a circular segment of the printing form 32 then dips into the electrolyte 36.

FIG. 6 illustrates a further embodiment of an electrode arrangement 38 in which the electrodes 39 lie in depressions 55. The electrode surfaces 58 form the bottom of the depressions 55. A capillary structure 47 is thereby also formed, and improves the adhesion of the inking medium 48, the dampening solution 27 and the electrolyte 36, respectively. A flow chart for the control device 42 is provided in FIG. 7. Thus, at 60, image processing is started and the operation flag input obtains at the interface of the controller 42. At 61, the pointer of the address controller is at start position. Data set for the n-th row from the interface are read at 62. At 63, the step of addressing the matrix cells 39 of the n-th row of the image area to be non-image fields of the picture occurs. The interrogation as to whether or not the matrix is completed appears at 64. If the matrix is not completed, the pointer goes to the next row at 65 and the sequence of steps beginning with the data reading step at 62 is repeated. If the matrix is completed, the operation flag is on "finished", as shown at 66. The set-up signal from the control computer of the printing machine is then awaited at 67. The processing voltage partially dissolving the hydrophobic layer is applied at 68. The set-up flag is then on status "finished", as shown at 69. At 70, the erase signal is awaited and the previously addressed matrix cells are reset at 71. The operation flag is then on status "ready" at 72, and the operation start signal is awaited from the computer of the printing machine at 73, and the entire process is then repeated.

I claim:

1. A printing machine for performing flat-bed printing having a printing form with hydrophobic and hydrophilic areas thereon corresponding to an image to be printed, and a device for electrochemically converting, respective areas thereof for producing a printing copy from the hydrophobic into the hydrophilic state, comprising a fluid applicator for applying a hydrophobic fluid to the entire surface of the printing form, a current-conducting arrangement for applying current to the hydrophobic fluid and a control device for controlling the current-conduction arrangement for selectively forming appropriate current paths and for electrochemically removing the hydrophobic fluid from areas of the printing-form surface corresponding to the hydrophilic areas required for the image to be printed, the current-conduction arrangement including an electrode arrangement, an electrolyte and at least one electric voltage source, the electrodes of said electrode arrangement forming a capillary structure in vicinity of the surface of the printing form.

2. Printing machine according to claim 1, wherein the electrodes project beyond the surface of the printing form.

3. Printing machine according to claim 1, each of the electrodes has a surface disposed at a distance from the surface of the printing form and forming a bottom of a depression.

* * * * *